US006209753B1

(12) United States Patent
Ohu

(10) Patent No.: US 6,209,753 B1
(45) Date of Patent: Apr. 3, 2001

(54) WATER DISPENSER FOR UPRIGHT STAND TYPE WATER BOTTLES

(76) Inventor: Hee-Bum Ohu, 7-402, Daelim Apt., 57 Jamwon-dong, Seocho-gu, Seoul (KR), 137-030

( * ) Notice: Subject to any disclaimer, the term of this patent is extended or adjusted under 35 U.S.C. 154(b) by 0 days.

(21) Appl. No.: 09/310,385

(22) Filed: May 12, 1999

(30) Foreign Application Priority Data

Oct. 22, 1998 (KR) ..... 98-20256
Feb. 9, 1999 (KR) ..... 99-4383

(51) Int. Cl.[7] ..... B67D 5/62

(52) U.S. Cl. ..... 222/64; 222/146.1; 222/189.09; 222/464.3

(58) Field of Search ..... 222/61, 64, 146.1, 222/185.1, 189.09, 380, 464.1, 464.3

(56) References Cited

U.S. PATENT DOCUMENTS 4,030,634 * 6/1977 Osborn ..... 222/64
5,439,145 * 8/1995 Salkeld et al. ..... 222/189.09
5,558,256 * 9/1996 Miller et al. ..... 222/189.09
5,992,684 * 11/1999 Russell ..... 222/146.1

* cited by examiner

*Primary Examiner*—Joseph A. Kaufman
(74) *Attorney, Agent, or Firm*—Dann, Dorfman, Herrell and Skillman, p.C.; Henry H. Skillman

(57) ABSTRACT

A water dispenser for upright stand water bottles includes a hollow post, a base plate which rests on the ground and supports an end portion of the post, a water tank assembly having a housing, a cover for opening or closing the housing, a water tank installed into the housing, and a unit for cooling or heating a water in the water tank, and which is installed to be attachable or detachable onto or from a holder to be coupled to another end portion of the post, a faucet for controlling a flow of the heated or cooled water from the water tank assembly, a suction tube one end portion of which is inserted into a water bottle resting adjacent the post so as to provide a path for supplying water in the bottle to the water tank assembly, a pump assembly which is connected to an intermediate portion of the suction tube so as to pump water from the water bottle, and a control for controlling the pump assembly.

26 Claims, 11 Drawing Sheets

FIG. 7A

Logic at a low-level

| Polarity changing signal | Power apply of water level sensor | Voltage level of 1st electrode | Voltage level of 2nd electrode | EX-OR input | Final output |
|---|---|---|---|---|---|
| HIGH | E1(LOW) ← E2(HIGH) | LOW | HIGH | HIGH/LOW | HIGH |
| LOW | E1(HIGH) → E2(LOW) | HIGH | LOW | LOW/HIGH | HIGH |

FIG. 7B

Logic at a full-level

| Polarity changing signal | Power apply of water level sensor | Voltage level of 1st electrode | Voltage level of 2nd electrode | EX-OR input | Final output |
|---|---|---|---|---|---|
| HIGH | E1(LOW) ← E2(HIGH) | LOW | LOW | HIGH/HIGH | LOW |
| LOW | E1(HIGH) → E2(LOW) | HIGH | HIGH | LOW/LOW | LOW |

WATER DISPENSER FOR UPRIGHT STAND TYPE WATER BOTTLES

BACKGROUND OF THE INVENTION

1. Field of the Invention

The present invention relates to a water dispenser, and more particularly to a water dispenser for upright stand type water bottles which allows an easy installation of the water bottle. In addition, users may selectively purchase one from among those for cool water, hot water, or for both use.

2. Description of the Related Art

Recently, as the public's awareness of the impurities in the public water supply increases, bottled drinking water is widely used in offices and homes throughout the world. As a result, water dispensers which can rapidly heat or chill the water have been introduced to allow people to drink hot and cool water.

These conventional water dispensers are designed such that water bottles are inverted and placing them onto the top of the dispensers in such a manner that the open end of the water bottle contacts the top of the dispenser. Thus, the water contained in the water bottle falls down as users want.

However, since the bottle filled with water is too heavy to lift up to the top of the dispenser, many individuals, especially senior citizens are reluctant to make use of such a conventional type of water dispenser. In addition, since the water bottle must be placed on top of the cabinet with the bottle's open end down, it is inevitable that water will occasionally spill onto the dispenser and floor, which creates further inconvenience and risk of injury. This conventional design also does not provide any means for preventing the open end of the dispenser from being contaminated.

To overcome such a problem, there has been proposed a water dispenser in which a water bottle is installed in a lower portion of the main body of the dispenser. Thus, the water in the bottle is pumped to the reservoir which is provided at the upper portion of the dispenser.

Referring to FIG. 1, a dispenser 100 has faucets 102, 103 which are provided at the upper portion of a front face of a main body 101 thereof. A tray 104 is provided under faucets 102, 103, and a cabinet 105 and a door 107 are provided in the lower portion of dispenser 100.

A groove 106 for guiding the water bottle is formed at the bottom surface of cabinet 105, and door 107 has a plurality of elongated holes 108 for checking the water bottle in cabinet 105. Magnets 109, 109' for closing door 107 are provided respectively at a predetermined portion of door 107 and at the corresponding portion of main body 101. An operation switch 110 which is operated according to door 107 in order to control a suction tube carrying device which will be described later is provided at main body 101.

As shown in FIGS. 2A and 2B, if a pulley 112 is driven by a motor, a suction tube 111 is wound around or off pulley 112, to thereby elevate or descend suction tube 111.

Suction tube 111 consists of a buffer unit 111*a* for preventing pulley 112 from being twisted to a pump, and a winding unit 111*b* connected to buffer unit 111*a* and which is wound around pulley 112 in accordance with the rotation of pulley 112. A guiding groove 112' for allowing a smooth winding of suction tube 111 is formed along the periphery of pulley 112. In addition, pulley 112 has a perforation 112" for connecting buffer unit 111*a* and winding unit 111*b* so as to allow a smooth operation of winding unit 111*b*. To prevent any damage onto suction tube 111, buffer unit 111*a* is connected to winding unit 111*b* via tube 111*c* made up of a plastic or an aluminum having a high stiffness.

Reference numeral 113 denotes a band fastener for fixing suction tube 111 onto the front surface of pulley 112.

Operation of the water dispenser will be explained with reference to FIGS. 1, 3A, and 3B.

The water contained in a bottle 140 in cabinet 105 is pumped into a cool water reservoir 116 via suction tube 111 and a conduit 115. Subsequently, the water pumped into reservoir 116 flows into a hot water reservoir 118 via conduit 117. The water in reservoirs 116 and 118 is chilled or heated by a cooling element 119 or by a die-casting heater 120.

To minimize the transmittance of the heat from hot water reservoir 118 to cool water reservoir 116, a connector 117' provided at the upper portion of cool water reservoir 116 is made up of a metal, for example, a brass. In addition, a connector 117" provided at the upper portion of hot water reservoir 118 is made up of a plastic, and conduit 117 for connecting both connectors 117' and 117" is made up of a silicon rubber.

Float sensors 121, 122 for sensing the amount of water are provided inside of reservoirs 116, 118 so as to control the operation of a pump 114. If reservoirs 116, 118 are filled with water, a sensor signal is transmitted from float sensors 121, 122 to a control unit(not shown) so as to stop the operation of pump 114. If reservoirs 116, 118 are not filled with water, pump 114 is driven so as to pump the water from water bottle 140.

When the user opens door 107 in order to change the water bottle, switch 110 is operated so as to rotate pulley 112 by a motor 123. Thus, suction tube 111 elevates winding onto pulley 112.

When the elevation of suction tube 111 completes, the empty water bottle is replaced by a new water bottle, and door 107 is closed, to thereby press switch 110. Then, suction tube 111 descends towards the inside of the newly replaced water bottle.

At this time, armatures 126, 127 fixed at pulley 112 are in contact with micro-switches 124, 125 at the upper end portion of a pulley fixation bracket 128. Thus, micro-switches 124, 125 are operated so as to detect whether suction tube 111 has completed an elevation or a descending. Motor 123 is controlled by a control signal which is output from a control unit according to the operation of micro-switches 124 and 125.

Reference numeral 129 denotes a sealing cap for preventing water bottle 140 from being contaminated, and reference numeral 130 denotes an intake block.

However, such a conventional water dispenser has problems as explained below.

First, it is difficult to replace water bottles because the cabinet for accommodating water bottles has a limited space.

In addition, a cool water reservoir, a hot water reservoir, and a means for chilling or heating the water have to be provided to the water dispenser, and a device for elevating or descending an suction tube is required, which increases a manufacturing cost. A person who intends to use only either hot or cool water has to purchase such a conventional dual-use water dispenser.

SUMMARY OF THE INVENTION

It is therefore an object of the present invention to provide a water dispenser for upright stand type water bottles in which water bottles can be easily replaced.

It is another object of the present invention to allow users to selectively purchase a water dispenser for cool water, hot water, or for dual use.

It is still another object of the present invention to provide a water dispenser for upright stand type water bottles with various design applied thereto.

To achieve the above objects and other advantages, there is provided a water dispenser for upright stand type water bottles including: a post; a base plate which rests on the ground and supports an end portion of the post; a water tank assembly having a housing, a cover for opening or closing the housing, a water tank installed in the housing, and a unit for chilling or heating the water in the water tank, and which is installed to be attachable or detachable onto or from a holder coupled to another end portion of the post; a faucet for controlling a flow of the heated or chilled water from the water tank assembly; a suction tube one end portion of which is inserted into a water bottle so as to provide a path for supplying the water in the bottle to the water tank assembly; a pump assembly which is connected to the suction tube so as to pump the water from the water bottle; and a control means for controlling the operation of the pump assembly.

According to the present invention, the water tank assembly includes those for exclusive use of cool water having a unit for chilling the water in the water tank, and those for exclusive use of hot water having a unit for heating the water in the water tank. Users may choose either the water tank assembly for exclusive use of cool, hot, cool/hot, cool/cool or hot/hot water.

Preferably, the water tank assembly further includes a cooling fan for discharging the heat generated from the inside of the housing. The housing further includes a vent for discharging the heat.

The water tank assembly further includes a water level sensing circuit having two electrodes for sensing the water level in the water tank. The water level sensing circuit inverses the polarity of the electrodes every predetermined period so as to remove ions contained in the water attached to the electrodes.

Preferably, the water level sensing circuit includes a control unit for outputting a polarity changing signal every predetermined period, a polarity changing unit for inversing the voltage of each electrode according to the polarity changing signal output from the control unit, a water level sensor unit having a water level sensor consisting of two electrodes and which senses a voltage level of either of the two electrodes so as to sense whether the electrode contacts the water, and a logical operation unit for outputting a water level signal according to the result of the sensing of the water level sensor unit and the polarity changing signal of the control unit.

The control unit includes a counter for counting predetermined periods and outputting a reset signal according to the result of the counting, and a polarity changing signal generating unit for generating a polarity changing signal according to the reset signal output from the counter.

The polarity changing unit includes a first inverter for firstly inverting the voltage of the polarity changing signal output from the control unit and providing the same to one of electrodes of the water level sensor, and a second inverter for secondly inverting the voltage of the polarity changing signal which is inversed by the first inverter and providing the same to another electrode.

The water level sensor unit includes a third inverter for inverting the voltage of one of the electrodes of the water level sensor, and outputting the inverted voltage to the logical operation unit.

The logical operation unit includes an exclusive OR element which performs an exclusive OR on the sensor signal output from the water level sensor unit and the polarity changing signal output from the control unit and outputs the sensor signal according to the result of the operation of the exclusive OR.

The base plate is provided with a switching means for controlling the power supplied to the pump and the control means, and has a groove or recess for accommodating water bottles.

The holder has a main body thereof at which a receptacle to be coupled with one end of the post is formed, and a protruded shaft which is extended from the main body of the holder at a predetermined angle and has at an end portion thereof a projection. The housing of the water tank assembly has a groove into which the projection of the protruded shaft is inserted.

As an embodiment, two protruded shafts are diverged from the main body of the holder, and the water tank assemblies for an exclusive use of cool water and for an exclusive use of hot water, respectively, are coupled to the two protruded shafts.

Preferably, when the projection formed at the end portion of the main body of the holder is inserted into the groove formed at the water tank assembly, the projection can be fixed to the housing using a locking means such as a screw.

In addition, a water catching tray one end portion of which is connected to the post and which projects from the post by a predetermined length can be further provided under the water tank assembly. Also, a cup holder one end portion of which is connected to the post and which projects from the post by a predetermined length can be further provided under the water tank assembly. The cup holder is a ring so that a cup can be held under the faucet by inserting it into the ring.

The pump assembly has a pump for pumping the water from the water bottle, and a pump case for accommodating the pump and which is fixed to the post. The pump case has a clip for holding the suction tube.

The suction tube of the present invention includes a first hose which is made up of a soft substance and has one end thereof connected to an intake port of the pump, a second hose which is made up of a hard substance and has one end thereof connected to the first hose and another end thereof provided with an absorption member to be inserted into the water bottle, and a third hose for connecting an outlet port of the pump and the water tank. Preferably, the second hose has a sealing cap which is made up of a soft substance and substantially seals the opening of the water bottle. The sealing cap has an air vent for an airflow between the interior and exterior of the water bottle. In addition, the sealing cap may have inside thereof a filtering member for filtering the air flowing into the water bottle via the air vent. As an embodiment, the second hose consists of two hoses which are interconnected by a connecting hose made up of a silicon.

The second hose has at an end thereof a check valve for preventing the water in the suction tube from flowing back. The check valve includes a hollow cylinder having at the bottom surface thereof a valve seat onto which a ball is loaded, an orifice, and a cap provided at the upper surface of the cylinder so as to restrict the movement of the ball.

As an embodiment, the water contained in the water tank is cooled using a thermoelectric cooling element.

Preferably, the water tank may have an air vent for an airflow between the interior and exterior of the water tank, and a filtering member for filtering the air flowed into the water tank via the air vent.

BRIEF DESCRIPTION OF THE DRAWINGS

The above object and other advantages of the present invention will become more apparent by describing in detail the preferred embodiments thereof with reference to the accompanying drawings, in which:

FIG. 7A illustrates a voltage level at a low-level water, and FIG. 7B illustrates a voltage level at a full-level water;

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those having skill in the art.

Figure 1:
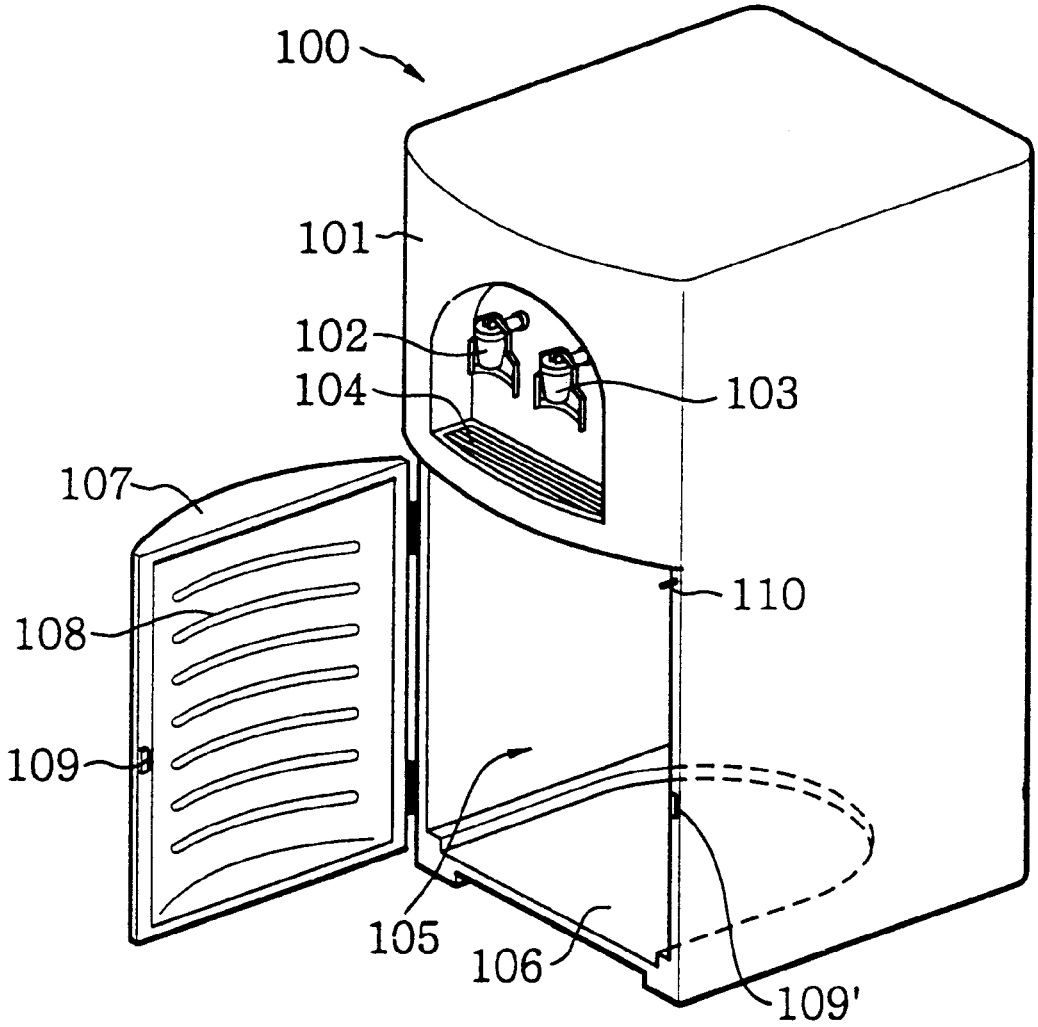
FIG. 1 (Prior Art)
FIG. 1 is a perspective view showing a conventional water dispenser.
Figure 2A:
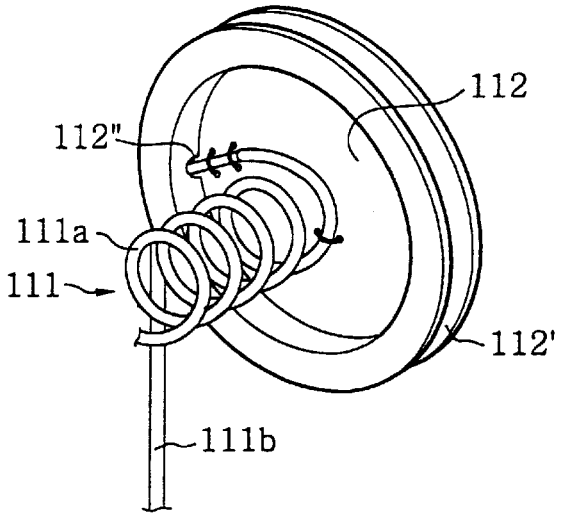
FIG. 2A (Prior Art)
FIG. 2A is a perspective view showing an elevating or descending device of a conventional water dispenser.
Figure 2B:
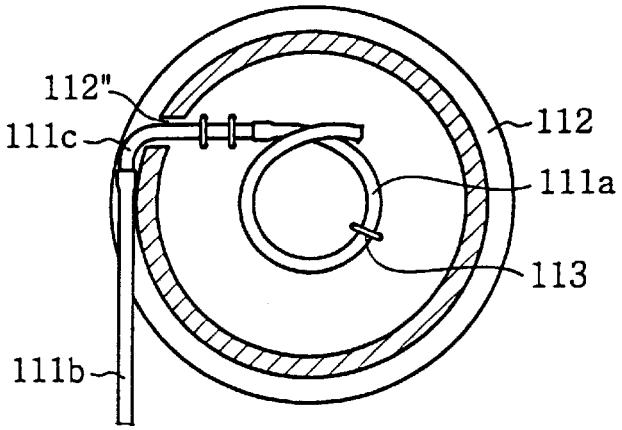
FIG. 2B (Prior Art)
FIG. 2B is a section view showing the elevating or descending device shown in FIG. 2A.
Figure 3A:
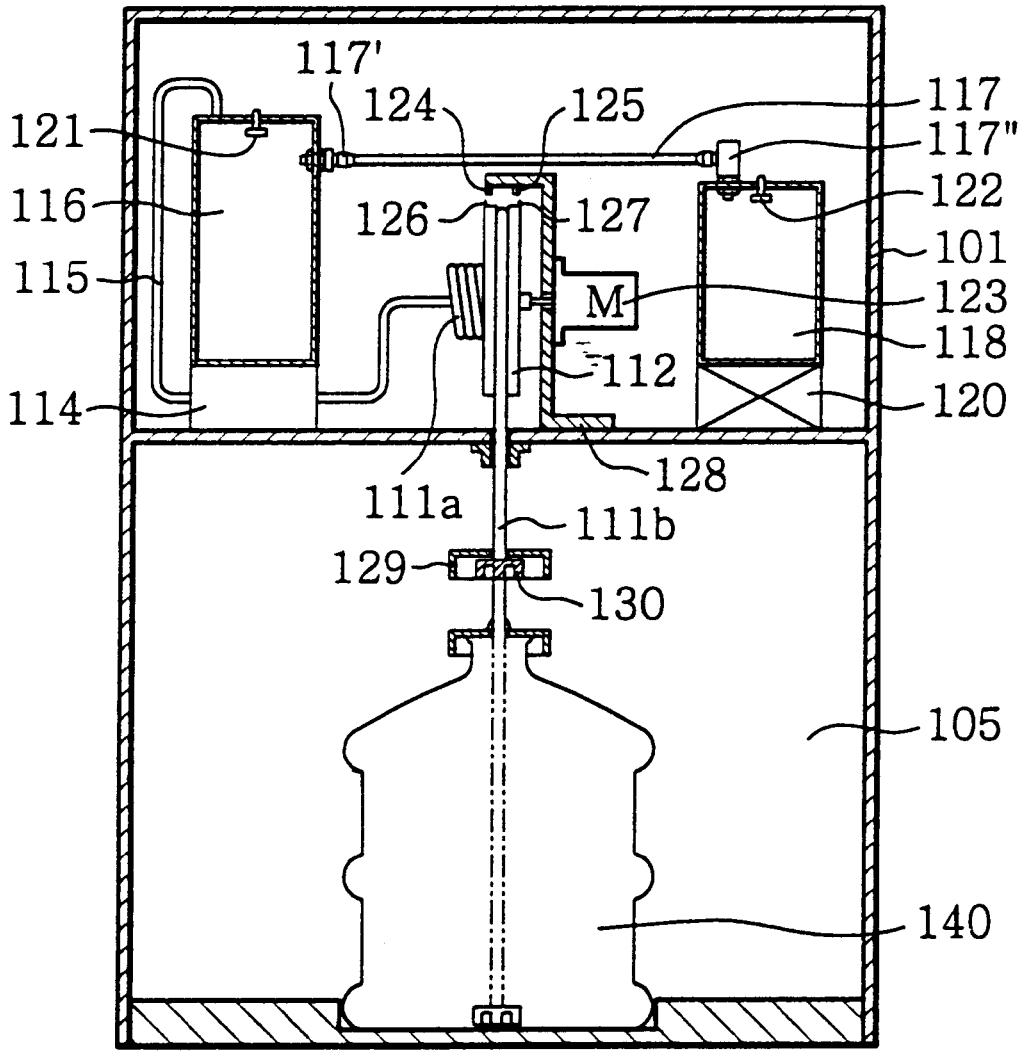
FIG. 3A (Prior Art)
FIG. 3A is a front section view showing a conventional water dispenser.
Figure 3B:
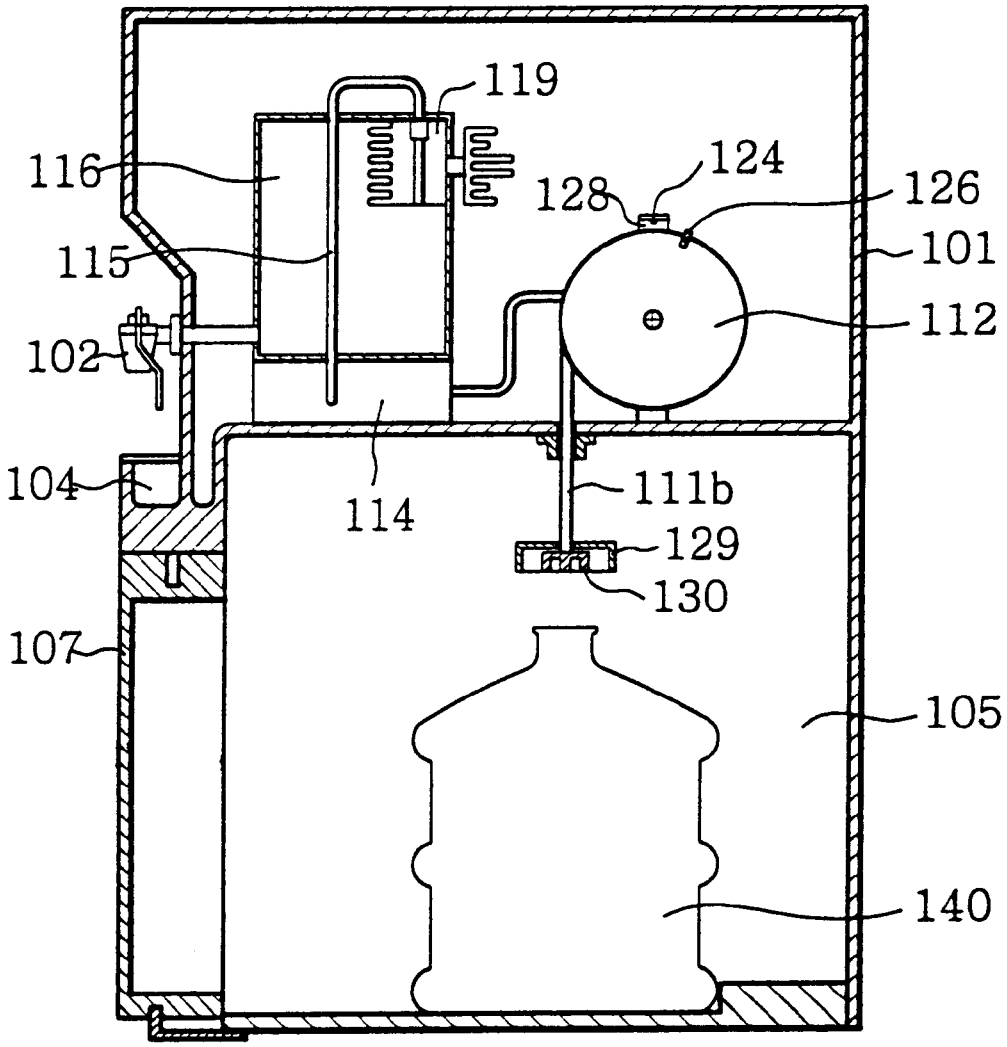
FIG. 3B (Prior Art)
FIG. 3B is a side section view showing the conventional water dispenser.
Figure 4:
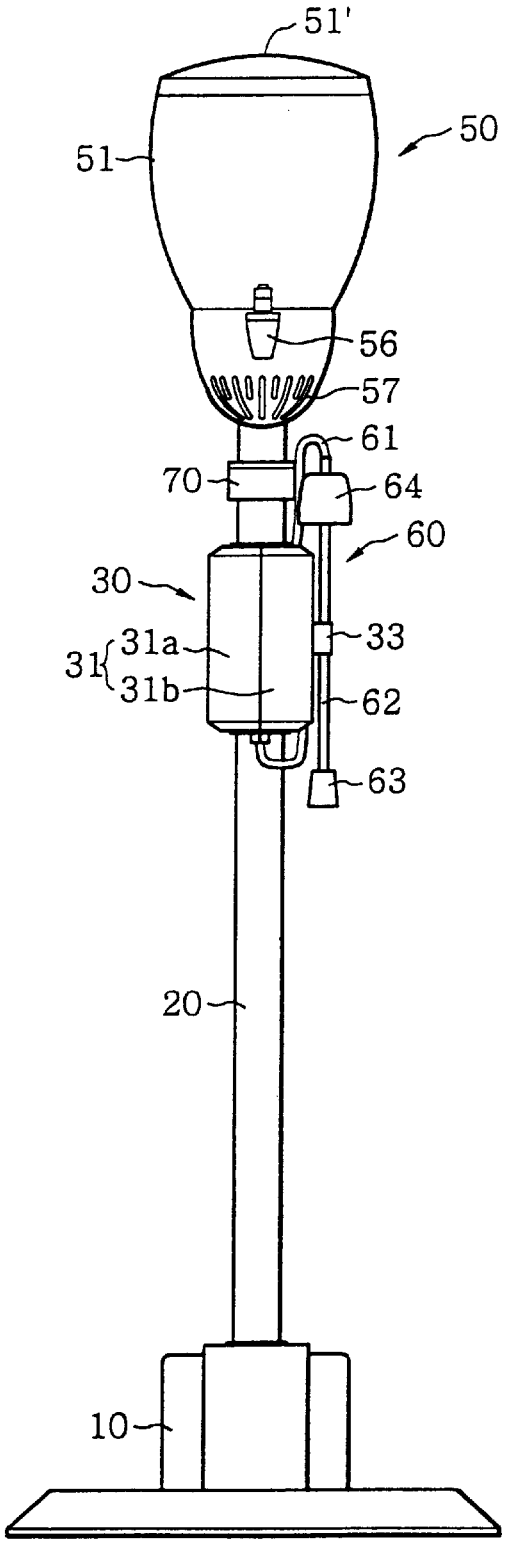
FIG. 4 is a front view showing a water dispenser for an upright stand type water bottle according to the present invention.
Figure 5:
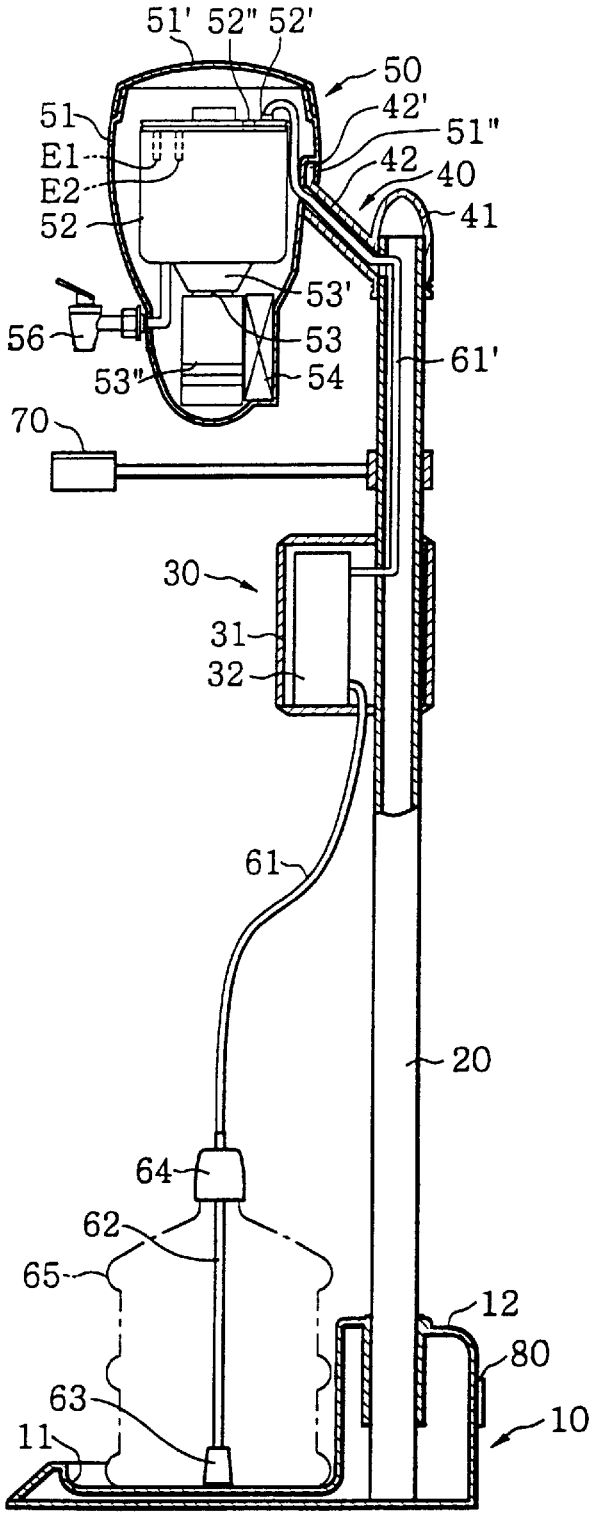
FIG. 5 is a section view showing a water dispenser for an upright stand type water bottle according to the present invention.

As shown in FIGS. 4 and 5, a base plate 10 has a water bottle loading portion 11 which is formed as a recess so that an water bottle 65 can be loaded standing upright, and a post supporting portion 12 is formed at the rear of water bottle loading portion 11.

Post 20 has one end thereof fixed by post supporting portion 12, an intermediate portion thereof provided with a pump assembly 30 for pumping the water from water bottle 65, and another end thereof provided with a water tank assembly 50 which is attachable and detachable by a holder member 40.

Post 20 is a hollow shaft that includes inside thereof a power supply circuit and a hose 61', which will be described later.

Pump assembly 30 includes a pump case 31 to be fixed onto post 20, and a pump 32 installed into pump case 31. Preferably, pump case 31 consists of injections 31*a* and 31*b*. In addition, a clip 33 for holding suction tube 60 when it is not used is provided at the side surface of pump case 31.

Water tank assembly 50 consists of a housing 51, a cover 51' for closing or opening housing 51, a water tank 52 installed inside of housing 51, units for heating or chilling the water in water tank 52, and a cooling fan 54 for discharging the heat generated from the inside of the housing 51 during the operation of the unit 53, 53', 53" for chilling the water.

The water tank assembly of the present invention may vary according to the use of the water dispenser. If a user intends to use a water dispenser exclusively for a hot water or a cool water, a water tank assembly in which a housing has inside thereof a cooling or a heating unit can be used.

Water tank assembly 50 further includes a water level sensing circuit having two electrodes E1 and E2 for sensing the water level in water tank 52. The water level sensing circuit is constructed to remove ions in the water which are attached to electrodes E1 and E2 by inversing the polarity of electrodes E1 and E2 every predetermined period.

Figure 6:
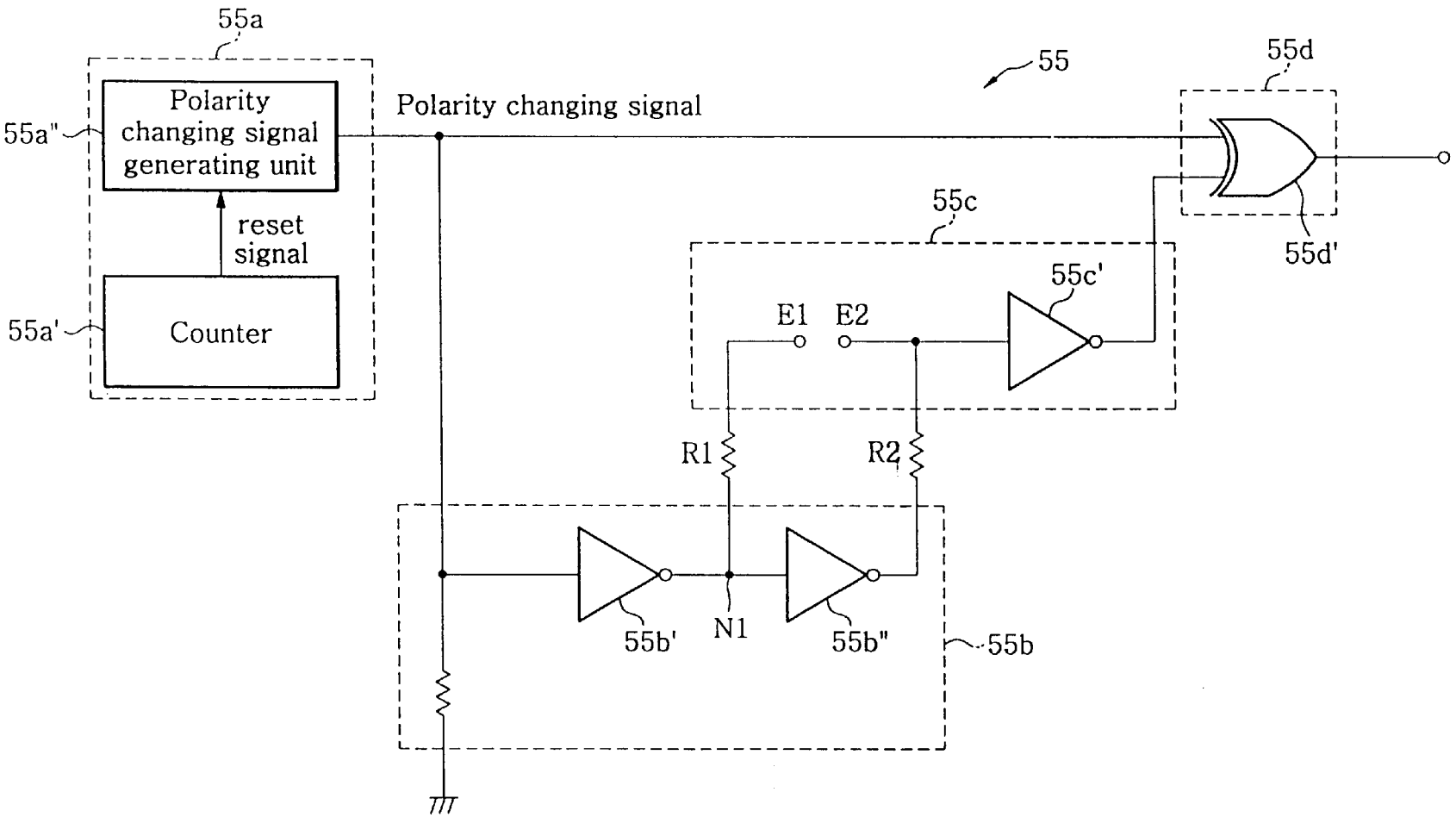
FIG. 6 illustrates a water level sensing circuit adopted to the water dispenser according to the present invention.

As shown in FIG. 6, a water level sensing circuit 55 includes a control unit 55*a* for periodically generating a polarity changing signal for changing the polarity to be supplied to the water level sensor, a polarity changing unit 55*b* for inverting the voltage of electrodes E1 and E2 according to the polarity changing signal output from control unit 55*a*, a water level sensor unit 55*c* provided with a water level sensor having electrodes E1 and E2 and which senses whether electrodes E1 and E2 contact the water by sensing the voltage level of one of the electrodes, and a logical operation unit 55*d* for outputting a water level signal according to the result of the sensing of water level sensor unit 55*c* and the polarity changing signal of control unit 55*a*.

Control unit 55*a* further includes a counter 55*a'* for counting a predetermined polarity changing period, and a polarity changing signal generating unit 55*a"* for outputting a polarity changing signal according to the result of the counting of counter 55*a'*. Here, counter 55*a'* may be structured to set a time that corresponds to a predetermined polarity changing period, and count down the time corresponding to such a period. When the countdown reaches zero, counter 55*a'* outputs a reset signal to polarity changing signal generating unit 55*a"* so as to invert the voltage level of the polarity changing signal.

Polarity changing unit 55*b* consists of a pair of inverters 55*b'* and 55*b"* which are connected in serial. Bifurcation point N1 between an output terminal of inverter 55*b'* and an input terminal of inverter 55*b"* is connected to first electrode E1 of the water level sensor in water level sensor unit 55*c* via a bias resistance R1. An output terminal of inverter 55*b"* is connected to second electrode E2 of the water level sensor in water level sensing unit 55*c* via a bias resistance R2, and is simultaneously connected to an input terminal of inverter 55*c'* in water level sensor unit 55*c*.

In addition, an output terminal of inverter 55*c'* of water level sensor unit 55*c* is connected to an input terminal of an exclusive OR element 55*d'* of logical operation unit 55*d*.

Exclusive OR element 55*d'* of logical operation unit 55*d* simultaneously receives the polarity changing signal output from polarity changing signal generating unit 55*a"* and the signal output from inverter 55*c'* of water level sensor unit 55*c*, performs a logical operation on the same, and outputs a water level sensor signal.

Now, an operation of the water level sensing circuit will be explained with reference to FIGS. 5 through 7.

When a user sets a polarity changing signal output time, which then is set to counter 55*a'*.

Subsequently, counter 55*a'* counts down the time, and outputs a reset signal to polarity changing signal generating unit 55*a"* when the counting reaches zero.

Polarity changing signal generating unit 55*a*″ inverts the voltage level (i.e., a polarity) which is output according to the reset signal output from counter 55*a*′.

As shown in FIGS. 7A and 7B, an output of inverter 55*b*′ is inverted to logic LOW, if a first polarity changing signal is assumed as logic HIGH. Therefore, first electrode E1 of the water level sensor unit 55*c* becomes logic LOW. Since the output of inverter 55*b* is inverted to logic HIGH, second electrode E2 of the water level sensor unit 55*c* becomes logic HIGH.

If the water in water tank 52 is at a low-level (i.e., if the water in water tank 52 does not reach the water level sensor), first and second electrodes E1 and E2 are opened, and the output of inverter 55*c*′ becomes logic LOW. Logic signal LOW output from water level sensor unit 55*c* is supplied to logical operation unit 55*d*. Subsequently, logical operation unit 55*d* performs an exclusive OR on the polarity changing signal at logic HIGH and the water level sensor signal at logic LOW, and outputs a water level signal at logic HIGH. The output of water level signal at logic HIGH indicates that the water in water tank 52 is at a low-level. Thus, pump 32 is driven so as to pump the water from water bottle 65.

If the water in water tank 52 is at a full-level (i.e., if the water in water tank 52 reaches the water level sensor), the voltage of second electrode E2 flows toward first electrode E1 via the water. Thus, the voltage of second electrode E2 becomes logic LOW, and an output of inverter 55*c*′ becomes logic HIGH. As a result, logic signal HIGH output from water level sensor unit 55*c* is supplied to logical operation unit 55*d*. Subsequently, logical operation unit 55*d* performs an exclusive OR on the polarity changing signal at logic HIGH and the water level sensor signal at logic HIGH, and outputs a water level signal at logic LOW. Therefore, if a water level signal at logic LOW is output, the water in water tank 52 is at a full-level, which stops the operation of pump 32. As a result, the water in water bottle 65 stops flowing toward water tank 52.

Meanwhile, counter 55*a*′ outputs a reset signal to polarity changing signal generating unit 55*a*″ when it reaches zero. Accordingly, polarity changing signal generating unit 55*a*″ outputs the polarity changing signal which is inverted to logic LOW. When a polarity changing signal is at logic LOW, an output of inverter 55*b*′ is inverted to logic HIGH, and first electrode E1 of the water level sensor becomes logic HIGH. In addition, an output of inverter 55*b*″ is inverted to logic LOW, second electrode of the water level sensor becomes logic LOW.

At this time, if the water in water tank 52 is at a low-level, first and second electrodes E1 and E2 are opened, and the output of inverter 55*c*′ becomes logic HIGH. Logic signal HIGH output from water level sensor unit 55*c* is supplied to logical operation unit 55*d*. Subsequently, logical operation unit 55*d* performs an exclusive OR on the polarity changing signal at logic LOW and the water level sensor signal at logic HIGH, and outputs a water level signal at logic HIGH. The output of water level signal at logic HIGH indicates that the water in water tank 52 is at a low-level. Thus, pump 32 is driven so as to pump the water from water bottle 65.

If the water in water tank 52 is at a full-level, the voltage of first electrode E1 flows toward second electrode E2 via the water. Thus, the voltage of second electrode E2 becomes logic HIGH, and an output of inverter 55*c*′ becomes logic LOW. As a result, logic LOW signal output from water level sensor unit 55*c* is supplied to logical operation unit 55*d*. Subsequently, logical operation unit 55*d* performs an exclusive OR on the polarity changing signal at logic LOW and the water level sensor signal at logic LOW, and outputs a water level signal at logic LOW. The output of a water level signal at logic LOW indicates that the water in water tank 52 is at a full-level, which stops the operation of pump 32. As a result, the water in water bottle 65 stops flowing toward water tank 52.

It can be seen from the above description that the signal to be finally output is determined by the result of the sensing of the water level sensor even when the voltage level of the polarity changing signal changes.

A power applying direction between first and second electrodes E1 and E2 is changed according to the change of the voltage level of the polarity changing signal. Thus, ions in the water which are attached to electrodes E1 and E2 as the water dispenser becomes old can be removed. That is, since the power applying direction between first and second electrodes E1 and E2 is periodically changed, ions at electrodes E1 and E2 of the water level sensor are detached when the polarity changes. As a result, a stabled water level sensing operation can be performed.

The above-described embodiment shows sensing of water level within one water tank. However, the water level sensing circuit having the above-described structure can be also applied when the water tank assemblies for an exclusive use of hot and for an exclusive use of cool water are employed.

When the water in the water bottle 65 is pumped by driving pump 32, if the water level signal is not inverted to logic LOW even when a predetermined time period elapses after pump 32 is driven, it is determined that the water in water bottle 65 is all consumed. Subsequently, an alarm is given to the user and pump 32 stops its operation.

Water tank 52 has at an upper surface thereof a connection unit 52' to which an end of suction tube 61' is connected, an air hole (not shown) for an airflow between the interior and exterior of water tank 52, and a filtering member 52" for filtering the air flowed into via the air vent.

Housing 51 has at the front surface thereof a faucet 56 for controlling a flow of the heated or chilled water from water tank 52, and has at the front, rear, left and right surfaces thereof a vent 57 for discharging the heat which is generated when the water is chilled, to the outside of housing 51 via cooling fan 54.

Preferably, a thermoelectric cooling element or a semiconductor element which can perform a cooling operation with less occupation is used as a cooling unit, considering that water tank 52 is accommodated into housing 51. Preferably, a band heater which wraps around the water tank or a seize heater is used as a heating unit.

In addition, a semiconductor element 53 which is formed by a junction of P-type and N-type semiconductors has a cold block 53' which is combined thereonto as a heat absorption member for effectively transmitting a cool temperature generated by operating semiconductor element 53 to water tank 52. Semiconductor element 53 further has a radiation member 53" which is combined therebelow for discharging a hot temperature generated by operating semiconductor element 53.

Preferably, as is not shown, a thermal insulation material is installed between housing 51 and water tank 52.

Holder member 40 for installing water tank assembly 50 to be attachable or detachable consists of a body 41 having a groove into which one end portion of post 20 is inserted, and a protruded shaft 42 which is extended from body 41 at a predetermined angle and has at an end portion thereof a projection 42'. Housing 51 has a groove 51" into which projection 42' of protruded shaft 42 is to be inserted.

Preferably, to firmly fix water tank assembly 50 to holder member 40, projection 42' of protruded shaft 42 is inserted into groove 51" of water tank housing 51, and projection 42' is firmly fixed to water tank housing 51 by using a screw (not shown).

Figure 10:
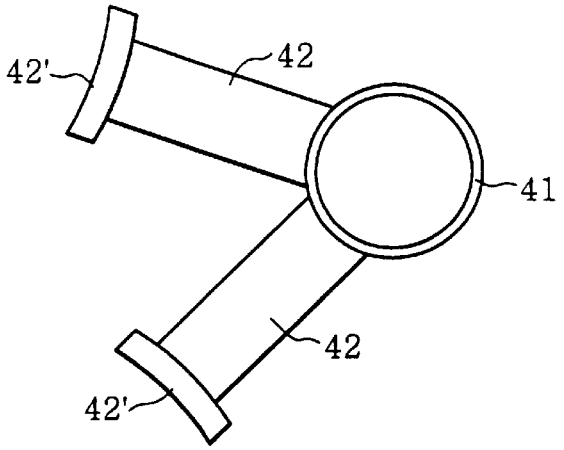
FIG. 10 is a plan view showing a holder according to a first embodiment of the present invention.

FIG. 10 illustrates a holder member according to another embodiment of the present invention. Here, body 41 provided with a groove into which a post is to be inserted has two shafts 42 which are protruded at a predetermined angle. Thus, water tank assemblies for exclusive use of hot and cool water, respectively, can be used simultaneously.

A tray 70 for catching the water falling from faucet 56 and which projects from post 20 by a predetermined length is installed above pump assembly 30. A switching unit 80 for controlling the power supplied to pump 32 and a control unit for controlling pump 32 is installed at the rear of base plate 10. Also, a cup holder (not shown) one end portion of which is connected to the post and which projects from the post by a predetermined length can be further provided under the water tank assembly. The cup holder is formed into a ring shape so that a cup can be held inserting into the ring.

Figure 8:
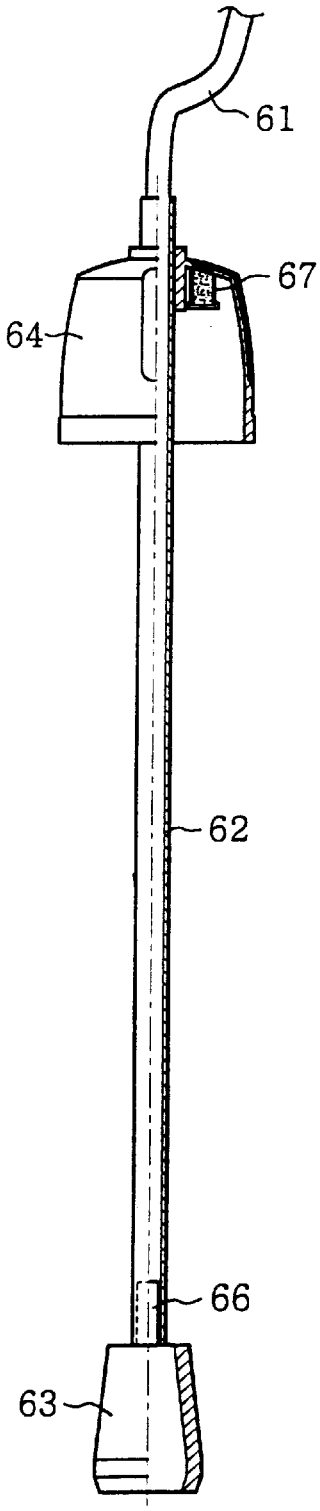
FIG. 8 is a section view showing a suction tube according to the present invention.

Meanwhile, as shown in FIG. 8, suction tube 60 which is connected to pump 32 so as to intake the water from water bottle 65 consists of a first hose 61 which is made up of a soft substance and has one end thereof connected to an intake part of the pump, a second hose 62 which is made up of a hard substance and has one end thereof connected to first hose 61 and another end thereof provided with a suction block 63 to be inserted into the water bottle, and a third hose 61' of FIG. 5 for connecting an outlet part of pump 32 and water tank 52. Second hose 62 is provided with a cap 64 for sealing the opening of water bottle 65 and which is made up of a soft polyvinyl chloride (PVC) or a silicon and installed to be slidable along second hose 62. Cap 64 has an air vent for an airflow between the interior and exterior of water bottle 65, and a filtering member 67 for filtering the air flowed into water bottle 65 via the air vent. Filtering member 67 is made up of a non-woven fabric or a zeolite.

Cap 64 is installed to be slidable to allow free use of suction tube 60 because water bottles manufactured by different manufacturers vary in height.

Figure 9A:
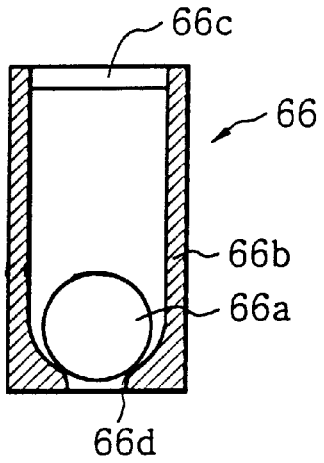
FIG. 9A is a section view showing a check valve according to the present invention.
Figure 9B:
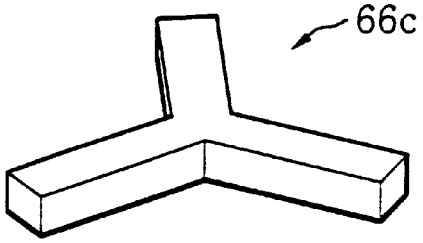
FIG. 9B is a perspective view showing a cap according to the present invention.

In addition, a check valve 66 for preventing the water contained in suction tube 60 from flowing back is provided at one end of second hose 62 which also has suction block 63. As shown in FIGS. 9A and 9B, check valve 66 consists of a hollow cylinder 66*b* having at the bottom surface thereof a valve seat 66*d* onto which a ball 66*a* is loaded, an orifice, and a cap 66*c* provided at the upper surface of cylinder 66*b* so as to restrict the movement of the ball.

Ball 66*a* is raised and contacts a bottom surface of cap 66*c* when the pump is driven, and drops onto valve seat 66*d* when the pump is not driven.

Any contamination which may be caused by a flowback of the water contained in suction tube 60 when water bottle 65 is replaced when pump 32 stops can be prevented by installing check valve 66 at one end of second hose 62.

Figure 11:
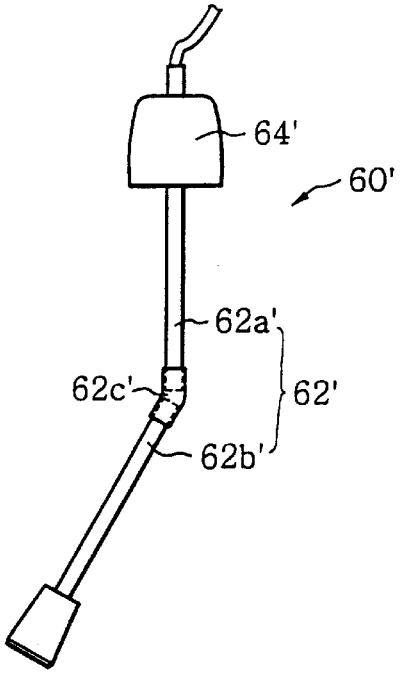
FIG. 11 illustrates the suction tube according to a second embodiment of the present invention.

FIG. 11 is a fragmentary view showing a suction tube 60' of another embodiment of the present invention, wherein second hose 62' consists of two hoses 62*a*′ and 62*b*′ which are interconnected by a connection hose 62*c*′ made up of a silicon. A cap 64' is fixed to hose 62*a*′. Thus, when cap 64' is fixed to the opening of water bottle 65 at the state where suction tube 60' is inserted into water bottle 65, second hose 62' is bent at connection hose 62*c*′. In such a manner, suction tube 60' of the present invention can be used for any type of water bottle.

The water dispenser of the present invention operates as follows.

First, the water bottle is positioned upright adjacent the post 20 preferably, the water bottle is placed on water bottle loading portion 11 of base plate 10. Then, suction tube 60 which is fixed by clip 33 of pump case 31 is inserted into the water bottle, and cap 64 of suction tube 60 is fixed to the opening of the water bottle.

Subsequently, pump 32 is driven so as to pump the water from the water bottle, and the pumped water is supplied to water tank 52 via suction tube 60. Here, the water pumped into water tank 52 is chilled by a cooling unit if water tank assembly 50 is for an exclusive use of cool water, and is heated by a heating unit if water assembly 50 is for an exclusive use of hot water. If water tank assembly 50 is for both use, the water pumped into two water tanks assemblies 52 used for hot and cold water, respectively, is chilled and heated.

As the chilled or heated water is consumed, and if it is sensed that the water in water tank 52 is at a low-level, the water in water bottle 65 is pumped into water tank 52 by driving pump 32. If it is not sensed that the water in water tank 52 does not reach the full-level even when a predetermined time period elapses after the driving of pump 32, an alarm sounds and the driving of pump 32 stops. At this time, users are allowed to replace the empty water bottle with the new one at the state where suction tube 60 is fixed by clip 33 of pump case 31.

In regard to the replacement of water bottles, the conventional system provides a restricted space for water bottle replacement, because the water bottle loading portion is within the main body of the water dispenser. However, in the present invention, water bottles may placed on the water bottle loading portion of the base plate or to any appropriate place adjacent the post, which allows a convenient replacement of water bottles.

In the conventional system, the water in suction tube 60 flows back when a pump stops its operation. However, the present invention eliminates such a flowback by installing the check valve into suction tube 60.

In addition, since the power applying direction between first and second electrodes E1 and E2 of the water level sensor unit is periodically changed, ions at electrodes E1 and E2 of the water level sensor unit are detached when the polarity changes. As a result, a stable water level sensing operation can be performed.

Furthermore, if a user intends to use the water tank assembly as an exclusive use for hot or cold water, he may open cover 51' of housing 51, detach suction tube 61' from connection unit 52' of water tank 52, and separates holder member 40 and water tank assembly 50 by disassembling the screw which is fixing projection 42' into groove 51". Then, the user can easily replace the water tank assembly in the reverse order.

As described above, the present invention has benefits which can be explained as follows. First, the space for an replacement of water bottles is not restricted, which allows an easy replacement of water bottles. In addition, users may selectively purchase one from among those for cold water, hot water, or for both use.

Moreover, users may use both cold and hot water by separately purchasing the water tank assembly and/or the holder member, which enhances a practical use and an economical efficiency.

Furthermore, the water dispenser of the present invention has an improved appearance, and the water flowback in the suction tube which is likely to occur when the water bottle is replaced can be prevented. The air which flows into the water bottle and the water tank passes through the filtering member, which prevents the water from being contaminated by the polluted air.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A water dispenser for upright stand type water bottles comprising:

a hollow post having opposite end portions;

a base plate adapted to rest on the ground, said plate supporting one end portion of said post;

a water tank assembly having a housing, a cover for opening and closing said housing, a water tank installed in said housing, a unit for cooling or heating a water in said water tank, and a holder which is attachable or detachable onto or from said tank assembly, said holder adapted to be coupled to another end portion of said post;

a faucet for controlling a flow of said heated or cooled water from said water tank assembly;

a suction tube assembly having one end portion adapted to be inserted into a water bottle resting adjacent said post and an opposite end portion connected to said water tank so as to provide a path for supplying water from said bottle to said water tank assembly;

said tube assembly including a pump connected intermediate the end portions of said suction tube assembly so as to pump water from said water bottle; and a control means for controlling said pump assembly.

2. The water dispenser according to claim 1, wherein said water tank assembly comprises at least two water tanks, one of said tanks being for cold water and having a cooling unit for cooling said water in said water tank and a second of said tanks being for hot water and having a heating unit.

3. The water dispenser according to claim 1, wherein said water tank assembly further comprises a cooling fan for discharging a heat generated from inside of said housing, and a vent for providing a path for discharging said heat.

4. The water dispenser according to claim 1, wherein said water tank assembly further comprises a water level sensing circuit having two electrodes for sensing the water level in said water tank, said water level sensing circuit adapted to periodically invert the polarity of said electrodes to remove ions of water attached to said electrodes.

5. The water dispenser according to claim 4, wherein said water level sensing circuit further comprises:

a control unit for outputting a polarity changing signal for periodically inverting the voltage;

a polarity changing unit for inverting the voltage of each electrode in response to said polarity changing signal output from said control unit;

a water level sensor unit having a water level sensor made up of said two electrodes and which senses whether said electrodes contact water by sensing the voltage level of one of said electrodes; and a logical operation unit for outputting a water level signal according to a sensor signal of said water level sensor unit and said polarity changing signal output from said control unit.

6. The water dispenser according to claim 5, wherein said control unit further comprises:

a counter for counting predetermined periods and outputting a reset signal according to the result of said counting; and a polarity changing signal generating unit for generating a polarity changing signal for inverting the voltage according to said reset signal output from said counter.

7. The water dispenser according to claim 5, wherein said polarity changing unit further comprises:

a first inverter for firstly inverting the voltage of said polarity changing signal output from said control unit and providing one of said two electrodes of said water level sensor with said firstly inverted voltage; and a second inverter for secondly inverting said voltage of said polarity changing signal which is inverted by said first inverter and providing another electrode of said two electrodes of said water level sensor with said secondly inverted voltage.

8. The water dispenser according to claim 5, wherein said water level sensor unit further comprises an inverter for inverting the voltage of either of said electrodes of said water level sensor and outputting said inverted voltage level to said logical operation unit.

9. The water dispenser according to claim 5, wherein said logical operation unit further comprises an exclusive OR element for performing an exclusive OR operation on said sensor signal output from said water level sensor unit and said polarity changing signal output from said control unit and outputting a water level signal corresponding to the result of said OR operation.

10. The water dispenser according to claim 1, wherein said base plate further comprises a switching device for controlling power supplied to said pump and said control means.

11. The water dispenser according to claim 1, wherein said base plate has a recess for accommodating said water bottle.

12. The water dispenser according to claim 1, wherein said holder is made up of a main body having a receptacle into which said another end portion of said post is to be inserted, and a shaft extending from said main body at a predetermined angle and having a projection at an end portion thereof, said housing of said water tank assembly having a groove into which said projection of said shaft is inserted.

13. The water dispenser according to claim 12, wherein said main body of said holder has a second shaft extending therefrom at a second predetermined angle.

14. The water dispenser according to claim 12, including a locking means to fix said projection of said shaft in said groove.

15. The water dispenser according to claim 1, further comprising a water catching tray one end portion of which is connected to said post, said tray projecting from said post by a predetermined length and underlying said water tank assembly.

16. The water dispenser according to claim 1, further comprising a cup holder having one end portion connected to said post, and a second portion projecting from said post by a predetermined length, under said water tank assembly, said cup holder having a ring so that a cup can be supported in the ring.

17. The water dispenser according to claim 1, wherein said pump has a pump case fixed to said post.

18. The water dispenser according to claim 17, wherein said pump case has a clip holding said suction tube.

19. The water dispenser according to claim 1, wherein said pump has an intake sort and an outlet port and said suction tube further comprises:

a first hose made up of a soft substance and having one end portion connected to said water intake port;

a second hose made up of a hard substance and having one end portion provided with a suction member to be inserted into said water bottle and another end portion of which is connected to said first hose; and a third hose for connecting a water outlet port of said pump and said water tank.

20. The water dispenser according to claim 19, wherein said second hose has a cap fixed thereon and which is made up of a soft substance and is adapted to substantially seal the opening of said water bottle, said cap having a hole for airflow between inside and outside of said water bottle.

21. The water dispenser according to claim 20, wherein said cap has inside thereof a filtering member for filtering said airflow through said hole.

22. The water dispenser according to claim 19, wherein said second hose has a check valve for preventing water in said suction tube from flowing back towards the end portion thereof having said suction member.

23. The water dispenser according to claim 22, wherein said check valve further comprises:

a hollow cylinder having surface and a bottom surface, said bottom surface forming a valve seat, a ball is loaded adapted to engage said valve seat, and a cap having a orifice mounted at said top surface of said cylinder to restrict movement of said ball.

24. The water dispenser according to claim 19, wherein said second hose is made up of two hoses which are interconnected by a silicon hose.

25. The water dispenser according to claim 1, including a cooling unit for said water in said water tank said unit comprising a thermoelectric cooling element.

26. The water dispenser according to claim 1, wherein said water tank has a hole for airflow between inside and outside of said water tank and a filtering member for filtering said airflow.

* * * * *

UNITED STATES PATENT AND TRADEMARK OFFICE

CERTIFICATE OF CORRECTION

PATENT NO. : 6,209,753 B1
DATED : April 3, 2001
INVENTOR(S) : Ohu

It is certified that error appears in the above-identified patent and that said Letters Patent is hereby corrected as shown below:

Column 13,
Line 2, "sort" should be -- port --;

Column 14,
Line 5, "having surface" should be -- having a top surface --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*